US006176057B1

(12) United States Patent
Bouchet et al.

(10) Patent No.: US 6,176,057 B1
(45) Date of Patent: Jan. 23, 2001

(54) HEAVY STUD SHOE

(75) Inventors: Robert D. Bouchet, San Ramon; Michael G. Wagner, Discovery Bay; Evon M. C. Ballush, Palo Alto, all of CA (US)

(73) Assignee: Simpson Strong-Tie Co., Inc., Pleasanton, CA (US)

( * ) Notice: Under 35 U.S.C. 154(b), the term of this patent shall be extended for 0 days.

(21) Appl. No.: 09/178,160

(22) Filed: Oct. 23, 1998

(51) Int. Cl.[7] ..... E04G 23/00

(52) U.S. Cl. ..... 52/514; 52/741.3; 52/149; 52/220.1; 52/220.2

(58) Field of Search ..... 52/514, 149, 741.3, 52/220.1, 220.2, 220.8, 712, 717.06; 174/48, 135

(56) References Cited

U.S. PATENT DOCUMENTS

| | | | | |
|---|---|---|---|---|
| 574,641 | | 1/1897 | Streator . | |
| 1,698,202 | | 1/1929 | Schuster . | |
| 2,103,064 | * | 12/1937 | Clark | 52/220.1 |
| 2,178,388 | | 10/1939 | Beckman . | |
| 3,208,119 | * | 9/1965 | Seckerson | 52/718 |
| 3,553,346 | * | 1/1971 | Ballantyne | 174/48 |
| 3,689,681 | * | 9/1972 | Searer et al. | 174/48 |
| 4,050,205 | * | 9/1977 | Ligda | 52/220.1 |
| 4,239,122 | | 12/1980 | Klein . | |
| 4,283,900 | * | 8/1981 | Schubert | 52/712 |
| 4,333,218 | * | 6/1982 | Wentworth | 52/514 |
| 4,516,365 | * | 5/1985 | Chapman | 52/514 |
| 4,862,667 | * | 9/1989 | Melland | 52/732 |
| 4,924,646 | * | 5/1990 | Marquardt | 52/221 |
| 5,146,720 | * | 9/1992 | Turner | 52/98 |
| 5,163,254 | | 11/1992 | Zastrow et al. . | |
| 5,287,664 | * | 2/1994 | Schiller et al. | 52/220.1 |
| 5,359,151 | * | 10/1994 | Nattel et al. | 52/359 |
| 5,503,371 | | 4/1996 | Bies . | |
| 5,519,977 | | 5/1996 | Callahan et al. . | |
| 5,531,054 | | 7/1996 | Ramirez . | |
| 5,598,680 | * | 2/1997 | Wilhelmi | 52/712 |
| 5,622,356 | | 4/1997 | Duggan . | |
| 5,678,381 | * | 10/1997 | DenAdel | 52/730.1 |
| 5,697,725 | * | 12/1997 | Ballash et al. | 52/712 |
| 5,720,143 | | 2/1998 | Soltis et al. . | |
| 5,782,048 | | 7/1998 | Ramirez . | |
| 5,794,390 | | 8/1998 | Oliveri et al. . | |
| 5,832,691 | * | 11/1998 | Callahan et al. | 52/737.3 |
| 5,857,295 | * | 1/1999 | Mikawa | 52/712 |
| 5,904,023 | * | 5/1999 | DiGirolamo et al. | 52/712 |
| 5,966,893 | * | 10/1999 | Quillin | 52/712 |
| 5,970,677 | * | 10/1999 | Masters et al. | 52/712 |
| 5,992,125 | * | 11/1999 | Hardy | 52/737.3 |

FOREIGN PATENT DOCUMENTS

| | | | | |
|---|---|---|---|---|
| 981558 | * | 1/1965 | (GB) | 52/220.1 |

OTHER PUBLICATIONS

Author Unknown, Simpson Company Catalog, No. 79H–1, Strong–Tie Timber Connectors pp. 26, 27, date: 1979.

Author unknown, Simpson Strong—Tie Co., Inc. catalog C–98, Wood Construction Connectors p. 64, effective date: Jan. 1, 1998.

* cited by examiner

*Primary Examiner*—Beth A. Stephan
*Assistant Examiner*—Dennis L. Dorsey
(74) *Attorney, Agent, or Firm*—James R. Cypher; Charles R. Cypher

(57) ABSTRACT

A weakened building member, having a building component running through an opening in it, is strengthened by reinforcing members attached to the building member that accommodate the presence of the building component. The reinforcing members are attached to the building member by fasteners or adhesives. The reinforcing members attach to at least one side of the building member. They extend from areas above the opening in the building member to areas below it, and pass around opposite sides of the building component. The reinforcing members can be positioned relative to each other prior to installation in such a manner as to allow the reinforcing members to slide around a building component that has already been run through the building member near their point of attachment to the building member.

21 Claims, 10 Drawing Sheets

HEAVY STUD SHOE

BACKGROUND

The present invention relates generally to structural framing members, and more particularly to a bracket for reinforcing a stud or similar building element having a hole or notch provided therein, through which a pipe or similar fixture has been inserted.

In present light building construction, it is very common for architects to specify the use of wooden studs as the vertical members of the load-bearing walls. Specifically, wooden 2×4 and 2×6 studs are often specified because they combine many desirable characteristics. They are available in standard sizes, they are easy to trim and otherwise work with, and they are relatively inexpensive. Most importantly of all to the present invention, they can be notched or have holes of selected dimensions formed in them without losing their design capacities. For example, the Uniform Building Code allows builders to remove 25% of the width of a stud in an exterior wall or a bearing partition by means of a notch or hole with no reduction in the load bearing capacity of the stud parallel to the grain of the wood. See Volume 2 of the Uniform Building Code, Section 2320.11.9 (1997 edition). The Uniform Building Code is published by the International Conference of Building Officials, located at 5360 Workman Mill Road, Whittier, Calif. 90601-2298, telephone: (800) 284-4406. This means that many electrical and plumbing conduits can be run within the load bearing walls without interfering with the structural characteristics of the wall. This is particularly important to architects and engineers, because this means they can ignore many electrical wiring and plumbing issues when designing the walls of the structure.

However, sometimes it is desirable or becomes necessary to remove more than the code-specified amount of material from a stud in a bearing wall. When this is the case, usually, it will be only one or two studs in a wall where an oversized notch or hole needs to be made. Of course, the designer can specify that larger studs be used in the wall so that the total percentage of material removed from the particular studs is within the code-specified limit, but this is wasteful, since only one or two studs really need to be larger. Furthermore, it is often only discovered that too much material needs to be removed from a stud after the wall has been almost completely erected. For example, sheathing will have been applied to one side of the wall, or fixtures attached, or upper levels of the structure built on top of the wall. In fact, many times it is an inspector who discovers that too much material has been removed from a stud for a plumbing conduit that has already been installed in a wall that is otherwise complete except for the finishing details. When this happens the cost of redesigning and rebuilding the wall becomes very high.

As an example of an oversized notch, plumbing return pipes are often nominally two inches in diameter, requiring a notch that is approximately 2.5" deep to be made in the stud to accommodate the pipe. A notch that is 2.5" deep in a 2×4 stud removes 71% of the width of the stud, exceeding the code's recommendation. A 2×4 stud has an actual width of 3.5". Such a notch even exceeds the code's recommendation for non-bearing partition walls where the notch can be 40% of the width of the stud.

The present invention is designed as a simple means to mend studs where too large a notch or hole has been made. The present invention seeks to mend the studs such that they can meet design compression load requirements. A Douglas Fir 2×4 stud has a cross-section that is 1.5" deep and 3.5" wide, and a compression loading capacity parallel to the grain of the wood that is 850 pounds per square inch. While such a stud can be considered to have a total bearing capacity of 4,462 pounds parallel to its grain, other structural limitations typically require that the design load for a 2×4 stud be much less. The inventor has informally surveyed designers and found that they rarely design compression loads on individual studs to be greater than 800 pounds. Through testing, the inventor has found that a shortened stud that has been sawn all the way through and then reinforced according to the present invention with a bracket formed according to the preferred embodiment and reinforced laterally has a design compression capacity of at least 1200 pounds.

SUMMARY OF THE INVENTION

It is an object of the present invention to provide a means for reinforcing a wooden framing member that has been weakened by means of a notch or hole.

It is a further object of the present invention to provide a means for reinforcing a framing member in which a notch or hole has been made that receives a utility conduit or similar building component.

It is another object of the present invention to provide a means for reinforcing a wooden framing member which may be used on site when notching of studs is necessary.

It is a further object of the present invention to provide a means of reinforcement which may be used on site after the stud has been notched or drilled and the utility conduit already inserted therethrough.

It is a further object of the present invention to provide a means of reinforcement which may be used after a utility conduit has been run through the stud, and siding or paneling has been attached to one of the edge faces of the stud, preventing access to the weakened portion from that edge of the stud.

It is a further object of the present invention to provide a means of reinforcement that is economical and simple to practice.

The present invention consists of a weakened building member, having a building component running through an opening in it, and reinforcing members attached to the building member that accommodate the presence of the building component. The reinforcing members are attached to the building member by fasteners or adhesives. The reinforcing members attach to at least one side of the building member. They extend from areas above the opening in the building member to areas below it, and pass around opposite sides of the building component. The reinforcing members can be positioned relative to each other prior to installation in such a manner as to allow the reinforcing members to slide around a building component that has already been run through the building member near their point of attachment to the building member.

DESCRIPTION OF THE PREFERRED EMBODIMENT

Figure 1:
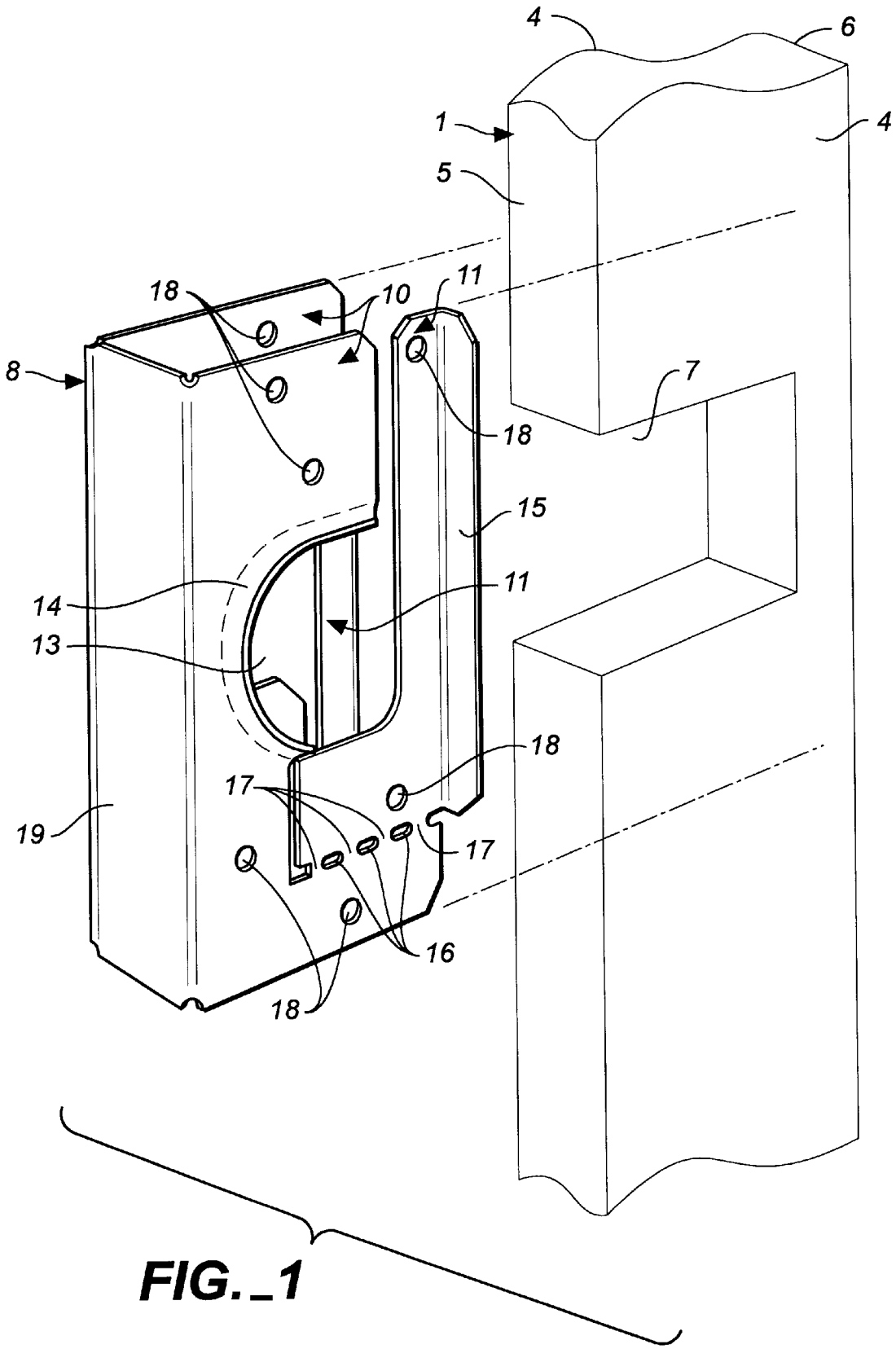
FIG. 1 is a perspective view of a bracket formed according to the preferred embodiment of the present invention and a weakened vertical member with a notch formed in it. The bracket is formed from two sets of first and second reinforcing members which are joined by a connecting web. Dashed lines indicate the direction of travel for the bracket when it is positioned on the stud.
Figure 2A:
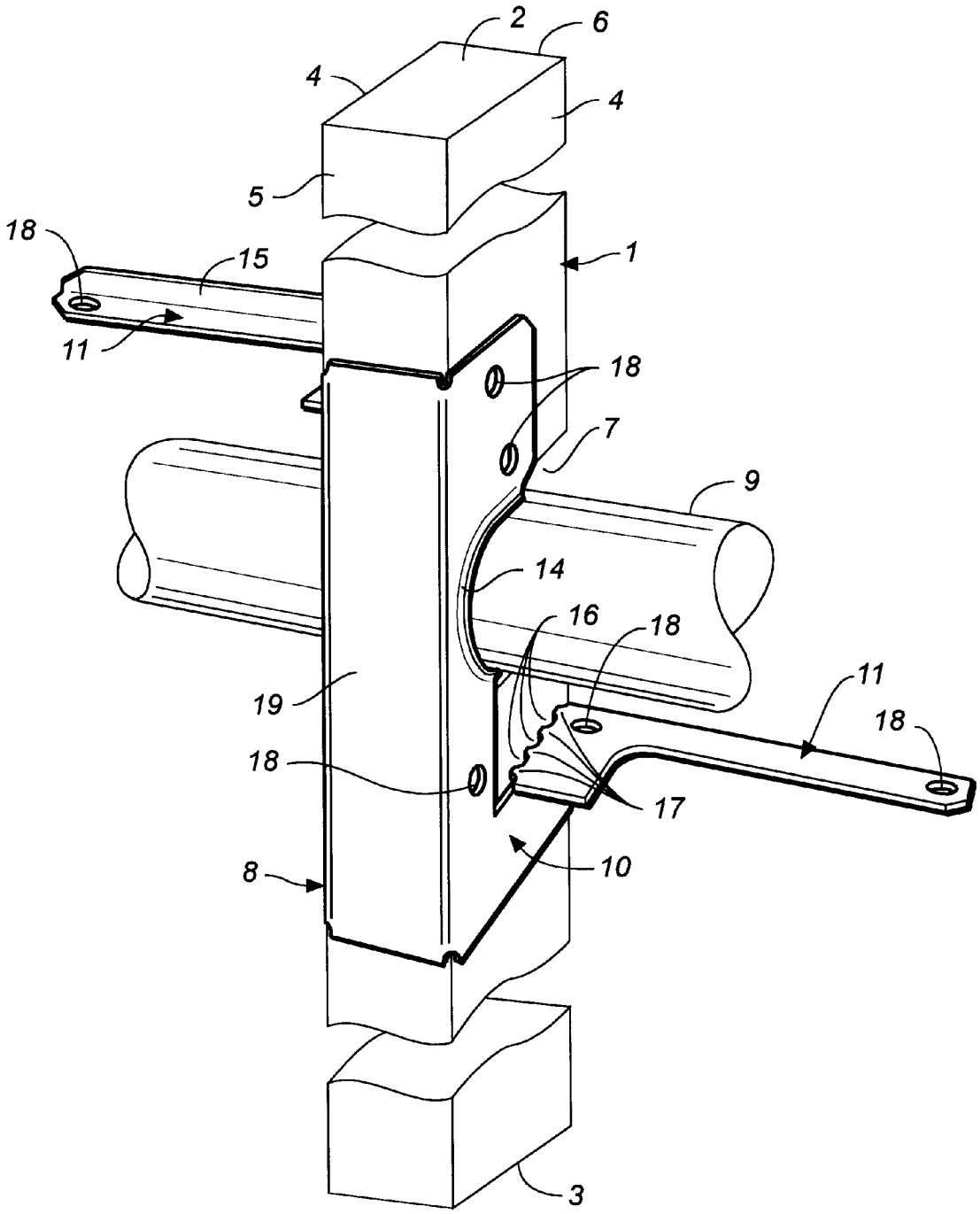
FIG. 2A is a perspective view of the bracket of the preferred embodiment inserted over a weakened vertical member that has a building component, specifically a utility pipe, running through it. The second reinforcing members are shown bent out of the plane defined by the first reinforcing members to allow the bracket of the preferred embodiment to be slipped past the building component.
Figure 2B:
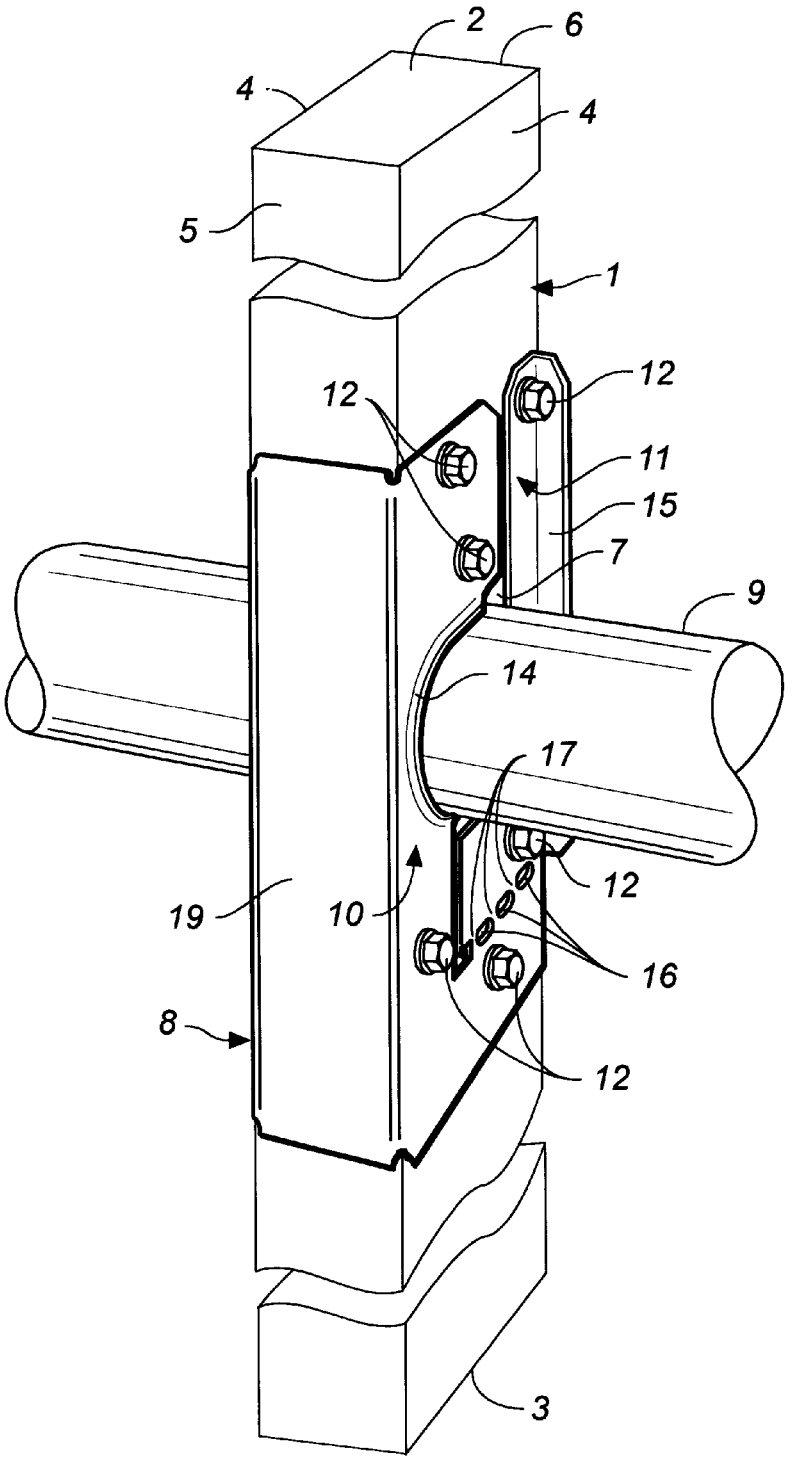
FIG. 2B is a perspective view of the preferred embodiment of the present invention. The bracket of the preferred embodiment is shown attached to the building member by means of threaded fasteners having hexagonal heads.
Figure 3:
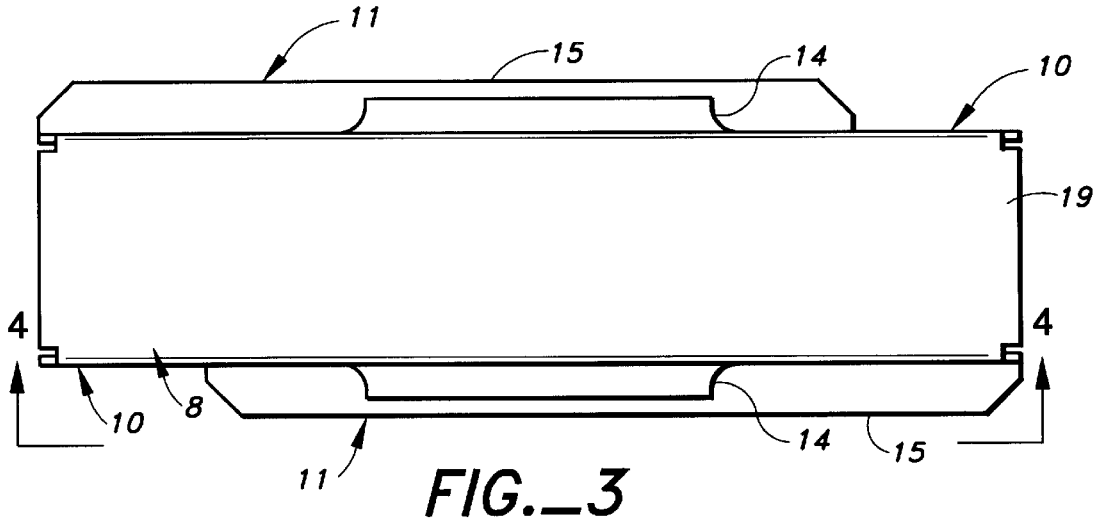
FIG. 3 is an end view of the bracket of the preferred embodiment of the present invention.
Figure 4:
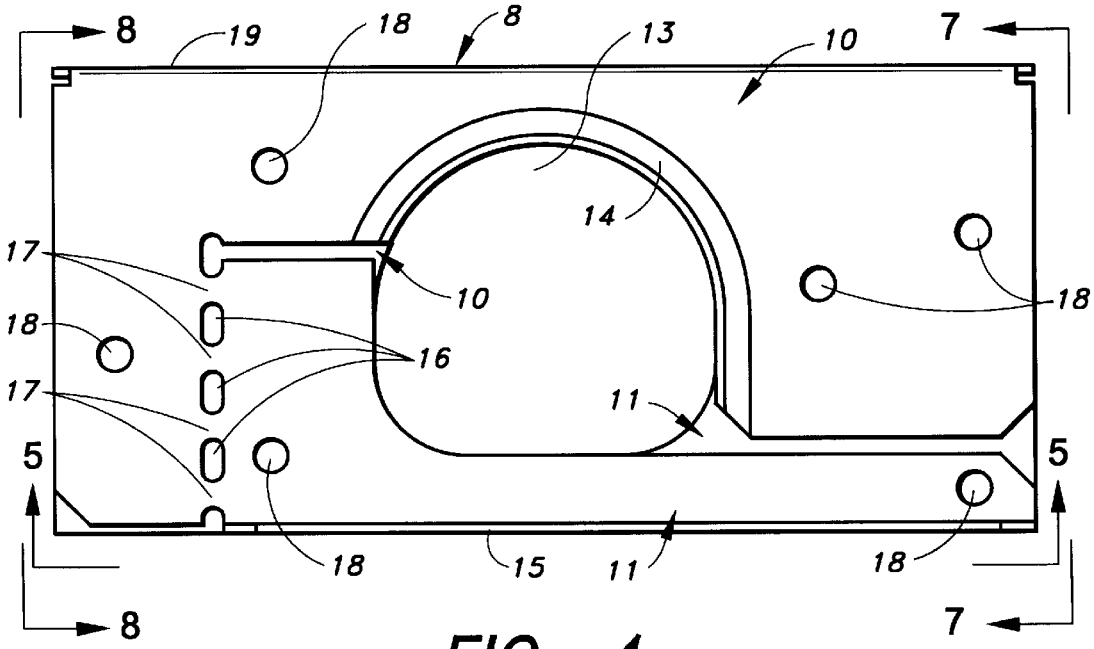
FIG. 4 is a side view of the bracket of the preferred embodiment taken along line 4—4 of FIG. 3.
Figure 5:
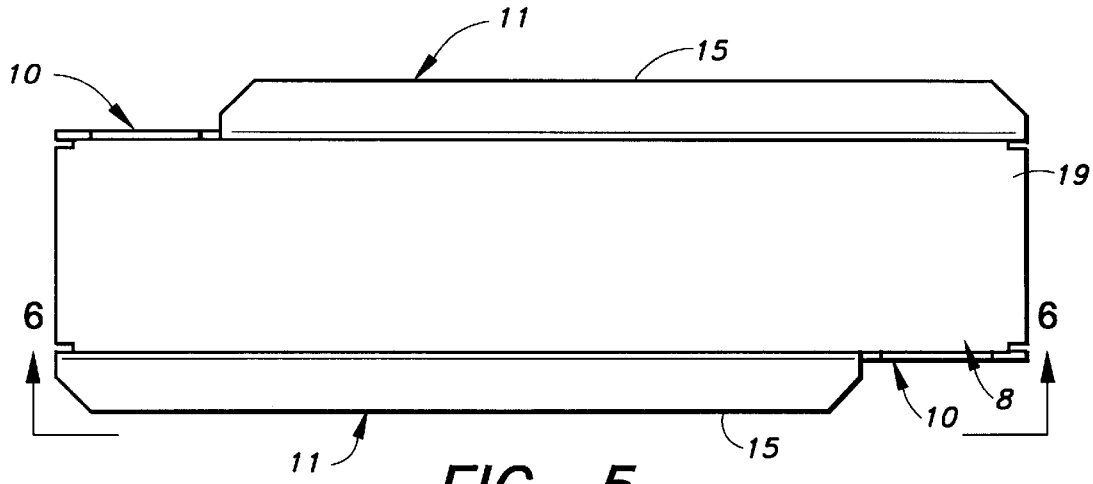
FIG. 5 is an end view of the bracket of the preferred embodiment taken along line 5—5 of FIG. 4.
Figure 6:
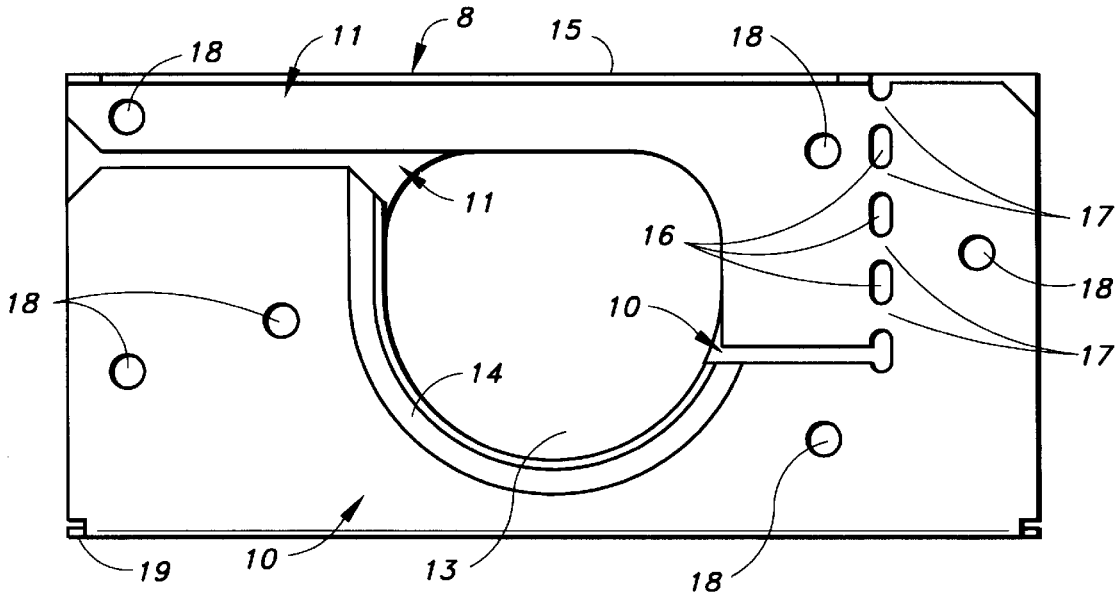
FIG. 6 is a side view of the bracket of the preferred embodiment taken along line 6—6 of FIG. 5.

Referring to FIG. 2, a building member 1 shown as a wooden stud, terminating at top and bottom ends 2 and 3 has a grain running along its length. The wooden stud 1 has a generally rectangular cross section taken perpendicular to the grain and presents generally parallel opposed side faces 4. The opposed side faces 4 have lengths commensurate with the length of the stud 1 and heights commensurate with the width of the stud 1. In use, the wooden stud 1 may be positioned with the side faces 4 oriented in vertical planes and with the length of the wooden stud 1 extending vertically, as is shown in FIGS. 1, 2A and 2B. The wooden stud 1 may also be used with the length extending horizontally or at an angle to the vertical.

The stud 1 is also formed with first and second edge faces 5 and 6 that have lengths commensurate with the length of the stud 1 and widths commensurate with the depth of the stud 1.

In the present invention, the stud 1 has been weakened by the removal of material from the stud 1. In particular, a cavity formed in one of the side faces 4 of the stud 1 passes through the stud 1 to the opposite side face 4, creating an opening 7 or hole in the stud 1. In typical applications, the opening 7 will also extend to the first edge face 5 such that it takes the form of a notch, as is shown in FIG. 1. It is to be noted that the preferred embodiment of the bracket 8 of the present invention has been tested on a stud 1 where the opening 7 completely traverses the cross-section of the stud 1; that is, the stud 1 was sawn all the way through, achieving desirable performance levels.

Openings 7 or notches are generally formed in studs 1 to receive utility conduits. As is shown in FIGS. 2A and 2B, a building component 9, specifically shown as a utility pipe, passes through the opening 7 in the stud 1. It is to be noted that the pipe 9, as shown in FIGS. 2A and 2B, is spaced away from the edge faces 5 and 6 of the stud 1, such that there is space between the edge faces 5 and 6 of the stud 1 and the pipe 9. This particular positioning of the pipe 9 in the stud 1 allows a reinforcing bracket 8 mounted to one side face 4 of the stud 1 to wrap around opposite sides of the pipe 9. See FIG. 2B.

Figure 11:
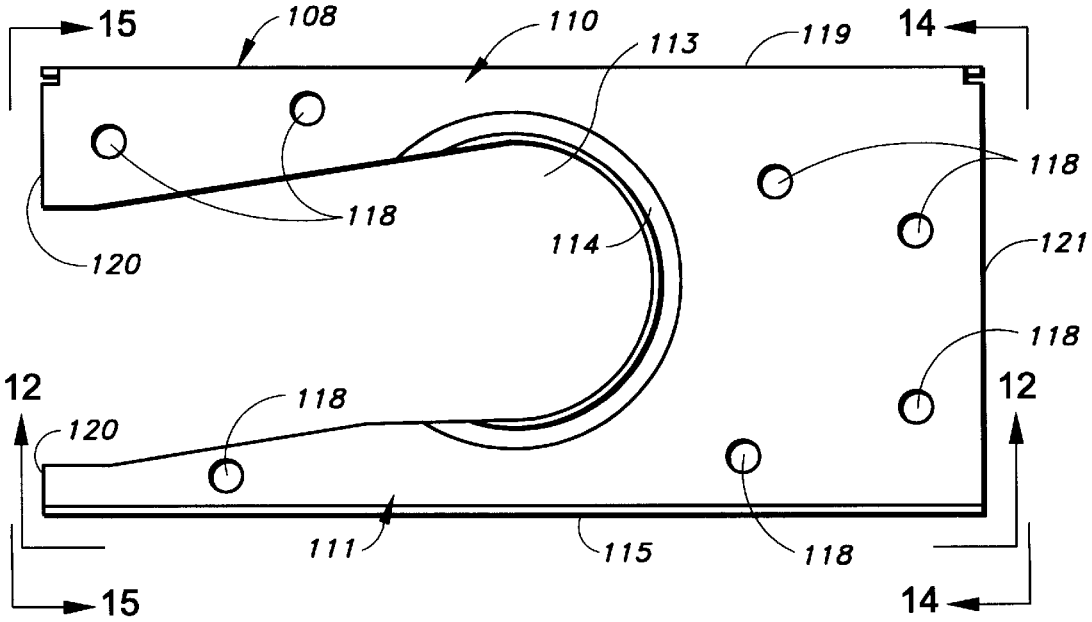
FIG. 11 is a side view of the alternate bracket shown in FIG. 10 taken along line 11—11 of FIG. 10.
Figure 12:
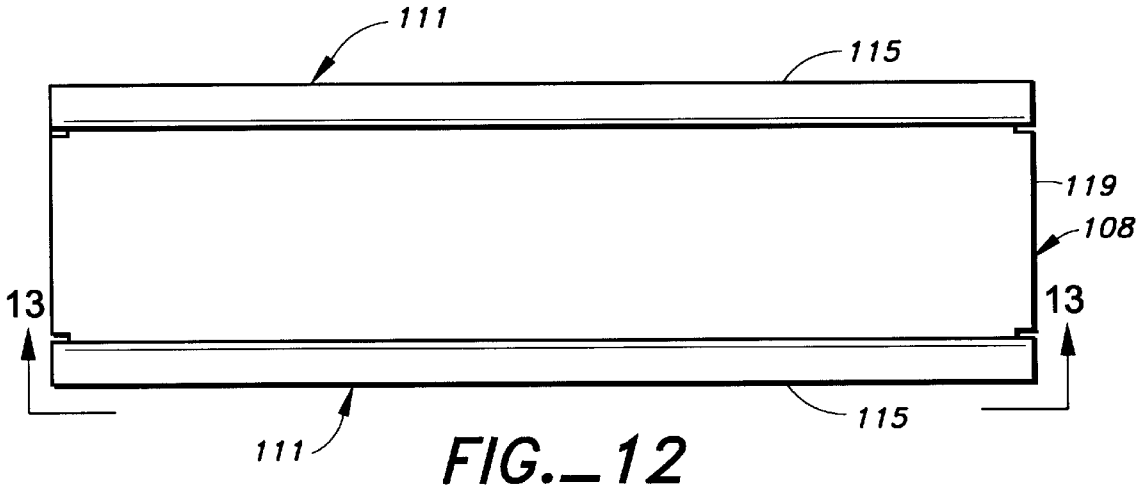
FIG. 12 is an end view of the alternate bracket shown in FIG. 10 taken along line 12—12 of FIG. 11.
Figure 13:
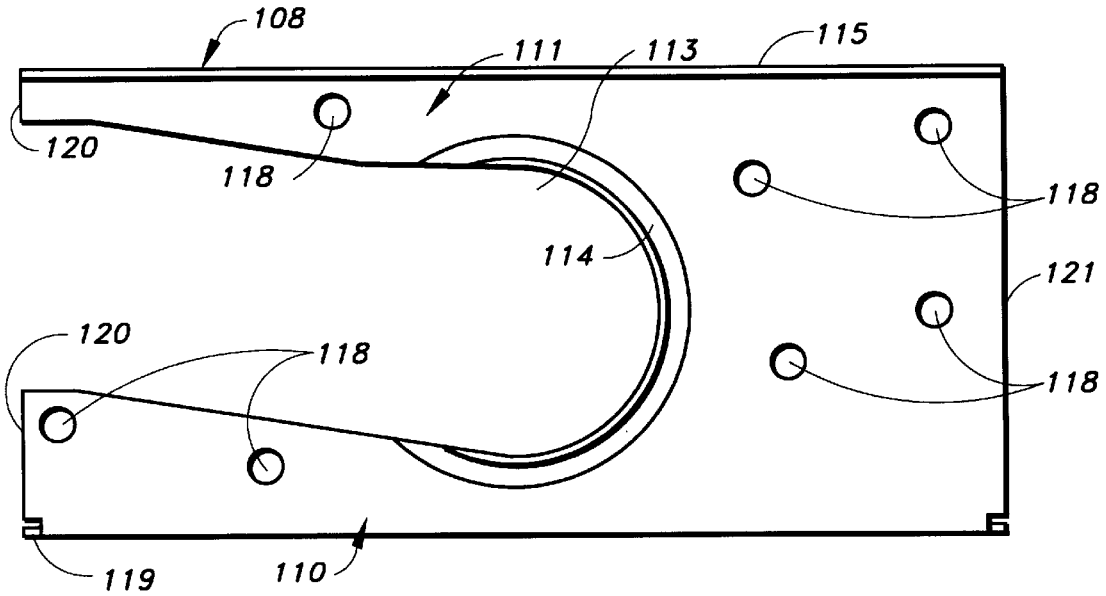
FIG. 13 is a side view of the alternate bracket shown in FIG. 10 taken along line 13—13 of FIG. 12.
Figure 14:
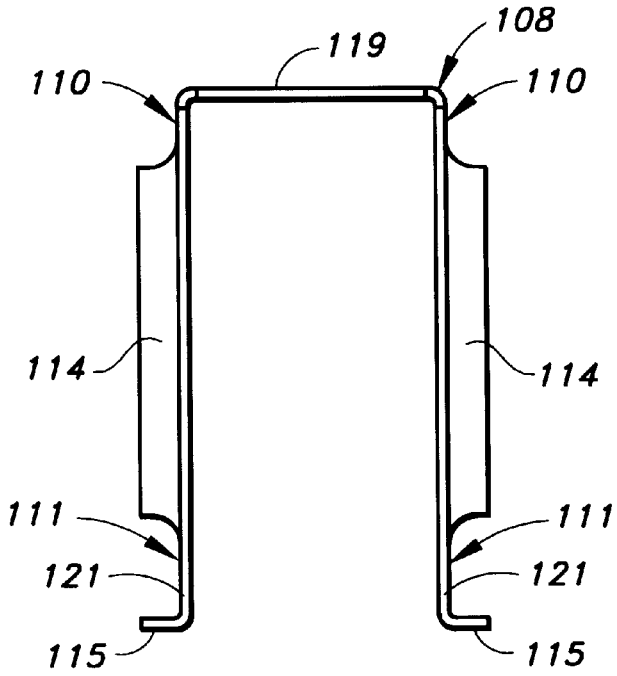
FIG. 14 is a top view of the alternate bracket shown in FIG. 10 taken along line 14—14 of FIG. 12.
Figure 15:
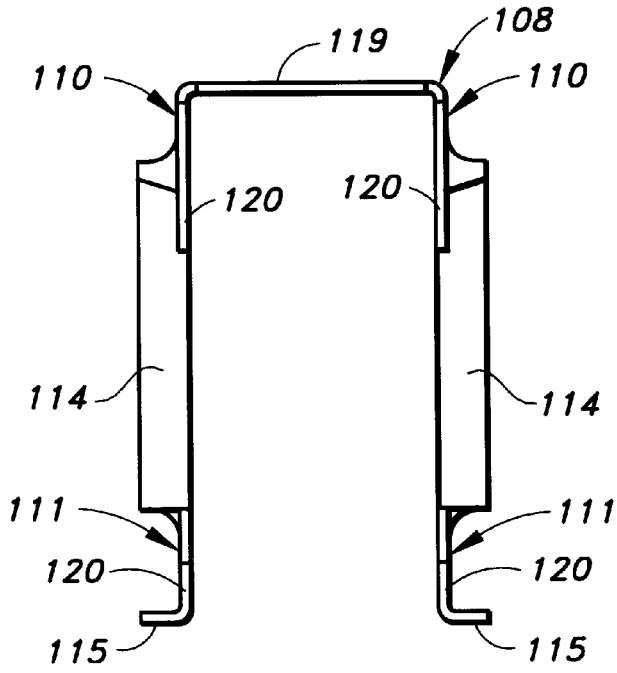
FIG. 15 is a bottom view of the alternate bracket shown in FIG. 10 taken along line 15—15 of FIG. 12.

As shown in FIGS. 1 and 11, according to the present invention means to reinforce a weakened stud consist of first and second reinforcing members 10 and 11. Portions of the first and second reinforcing members 10 and 11 are disposed in registration with the same side face 4 of the stud 1. Each of the reinforcing members 10 and 11 is long enough to extend from an area above the opening 7 in the stud 1 to an area below the opening 7 in the stud 1 when properly positioned on the side face 4 of the stud 1. See FIGS. 2A and 2B. The first and second reinforcing members 10 and 11 wrap around or pass by the pipe 9. The first reinforcing member 10 passes around the pipe 9 and through the space between the pipe 9 and the first edge face 5, and the second reinforcing member 11 passes around the pipe 9 and through the space between the pipe 9 and the second edge face 6.

The first and second reinforcing members 10 and 11 are joined to the stud 1 in the areas above and below the opening 7 in the stud 1. This is done by means 12 for joining the first and second reinforcing members 10 and 11 to the stud 1, which can be wood screws, nails, adhesives, bolts, lag screws, rivets, pins or other similar fasteners. Wood screws are preferred. See FIG. 2B.

In the present invention, the first and second reinforcing members 10 and 11 must be able to adopt positions relative to each other prior to their attachment to the stud 1 that will allow the reinforcing members 10 and 11 to be attached after the pipe 9 has been inserted through the opening 7 in the stud 1. Typically, the pipe 9 is elongated, the ends of which are displaced far from the weakened stud 1. Furthermore the pipe 9 will usually pass through additional structural members, such as the bottom plate of the wall, preventing easy access to its ends. Even if an end of the pipe 9 is close, there will usually be a fixture attached to it which prevents the pipe 9 from being threaded between the reinforcing members 10 and 11. Thus, the reinforcing members 10 and 11 cannot travel down the length of the pipe 9 to the side face 4 of the stud 1 where they will attach. Thus, it is necessary for the reinforcing members 10 and 11 to be able to be slipped around the pipe 9 approximately at the point where they will be attached to the side face 4 of the stud 1.

This object is achieved in the present invention by forming the first and second reinforcing members 10 and 11 in such a manner that the second reinforcing member 11 can be disposed in relation to the first reinforcing member 10 prior to installation in such a way as not to interfere with the first reinforcing member 10 being moved into position for attachment to the building member 1 by generally aligning the first reinforcing member 10 with the generally planar side face 4 to which it will attach and sliding it along the plane of the side face 4 into position. See FIGS. 2A and 11.

In the bracket 8 of the preferred embodiment, the first and second reinforcing members 10 and 11 are connected and are generally disposed in the same plane. See FIG. 1. However, they are connected in such a manner as to allow the second reinforcing member 11 to be swung out of the plane. See FIG. 2A. If the first and second reinforcing members 10 and 11 were not connected, the same object would be achieved; that is, the first reinforcing member 10 could be attached by aligning it generally with the plane of the side face 4 to which it will attach and sliding it along the plane until it is in position. However, it is preferred to attach the first and second reinforcing members 10 and 11 to make sure that both are installed.

In the bracket 108 of the alternate embodiment shown in FIGS. 10–15, the first and second reinforcing members 110 and 111 are connected; however, the first and second reinforcing members 110 and 111 extend well beyond and substantially parallel to each other away from this area of connection. Furthermore, except for this area of connection and the areas near it, they are spaced far enough from each other, such that the building component 9 can pass between them. This allows the first and second reinforcing members 110 and 111 to remain fixed with respect to each other while the first reinforcing member 110 is slid onto the building member 1 at its point of attachment and next to the building component 9 as is dictated by the present invention.

Figure 9:
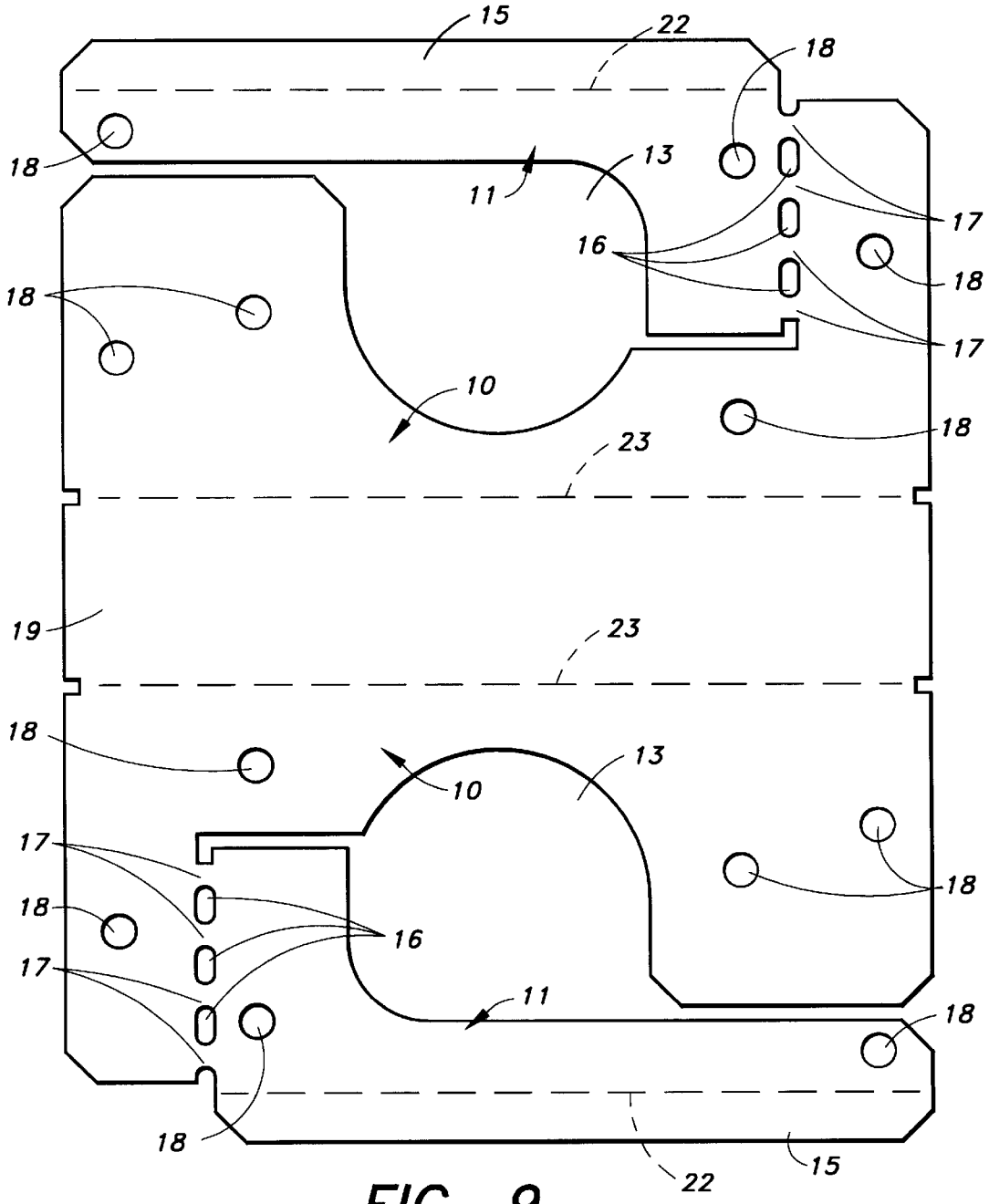
FIG. 9 is a top plan view of the blank from which the bracket of the preferred embodiment is formed.
Figure 10:
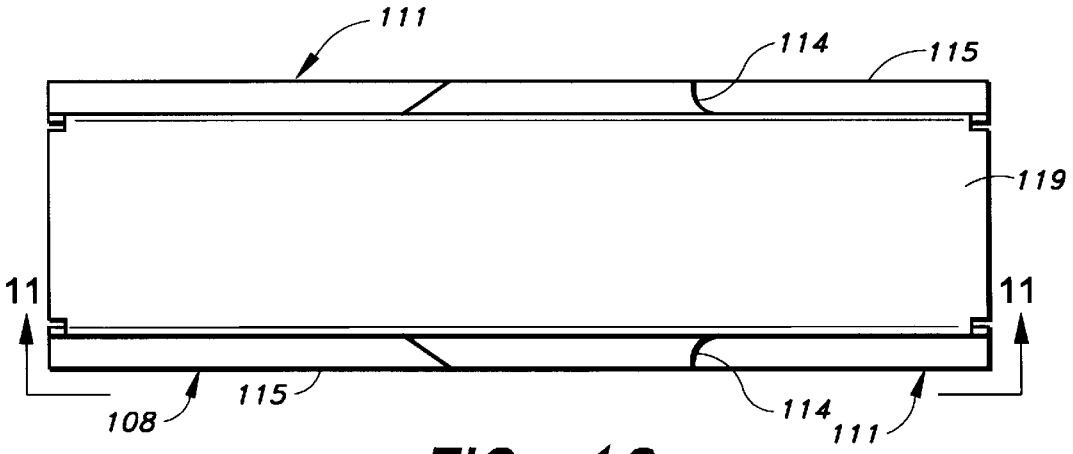
FIG. 10 is an end view of an alternate bracket formed according to the present invention.

As is shown in FIG. 1, in the preferred embodiment, the first and second reinforcing members 10 and 11 are formed together as a unit in a single plane. The preferred embodiment of the bracket 8 is formed from a single blank of sheet metal cut and punched, and then bent to adopt the final form of the bracket. See FIG. 9 which shows the blank for the preferred embodiment of the bracket 8 formed according to the present invention. The first and second reinforcing members 10 and 11 are shaped so that a main opening 13 is disposed between them. The main opening 13 is adapted to receive the building component 9 therethrough. Along the perimeter of the main opening 13 where it is bordered by the first reinforcing member 10, a drawn reinforcing flange 14 is formed to strengthen the bracket 8. See FIG. 1. Otherwise, the first reinforcing member 10 is substantially planar.

The second reinforcing member 11 is also formed with a strengthening flange 15 along its outer edge. This strengthening flange 15 is bent up at 90 degrees from the plane defined by the first reinforcing member 10. In the preferred embodiment, the strengthening flange 15 extends the length of the second reinforcing member 11.

In the preferred embodiment, at the interface between the first reinforcing member 10 and the second reinforcing member 11, a series of weakening openings 16 are formed in the metal of the sheet metal blank to form a bendable area 17. See FIG. 1. These openings 16 facilitate the bending of the second reinforcing member 11 out of the plane defined by the first reinforcing member 10, so that the bracket 8 can be slid onto the building member 1 and around the building component 9. See FIG. 2A. When the bracket 8 is in position with the first reinforcing member 10 in registration with the side face 4 of the building member 1, the second reinforcing member 11 is bent back into the plane of the first reinforcing member 10 so that the two are in registration with the side face 4 of the building member 1. Fasteners 12 are then driven into the building member 1 through fastener openings 18 in the bracket 8. It is to be noted that in the bracket 8 of the preferred embodiment, where the bracket 8 is formed from light gauge galvanized sheet metal, it is preferred that the second reinforcing member 11 be bent out of alignment with the first reinforcement 10 member only once. The sheet metal of the bracket 8 can become overworked, if it is bent too much, which could decrease the performance levels of the bracket 8. Over working the second reinforcing member 11 so much that it separated from the first reinforcing member 10 does not prevent the bracket 8 of the preferred embodiment from being used for its inventive purpose. However, any design values provided by the manufacturer of the bracket 8 of the preferred embodiment are based on the second reinforcing member 11 remaining connected to the fist reinforcing member 10 and manipulated only as instructed.

As is shown in FIG. 1, in the preferred embodiment, the first reinforcing member 10 is formed with two fastener openings 18 in the portion of the first reinforcing member 10 above the main opening 13 in the bracket 8, and with two fastener openings 18 in the portion of the first reinforcing member 10 below the main opening 13. The second reinforcing member 11 is formed with one fastener opening 18 above the main opening 13 in the bracket 8, and with one fastener opening 18 below the main opening 13 in the bracket 8.

The preferred fasteners 12 are Simpson Strong-Drive wood screws, suitably dimensioned for the particular building member 1. If a 2× wood stud 1 is used, then the fasteners 12 should be SDS¼"×1 1/2" wood screws. These screws 12 are made from Grade 5 steel and coated with yellow zinc dichromate. They are preferably installed with a low speed ½" right angle drill with a ⅜" hex head driver. They can be drilled directly into the stud 1 without the use of a pilot hole and without splitting the wood. The fasteners openings 18 in the bracket 8 are specifically designed for these screws 12 which have a ¼" diameter. The openings 18 are spaced from each other and from the edges of the bracket 8 so that the screws 12 will not split the wood. They are also designed to meet as best as possible the recommendations in the 1991 Commentary on the National Design Specification for Wood Construction. This standard is published by the American Forest & Paper Association, American Wood Council which is located at 1111 19th Street NW, Suite 800, Washington, D.C. 20036. They are also designed to meet as best as possible the recommendations in the 1996 American Iron and Steel Institute's Cold-Formed Steel Design Manual. The institute's address is P.O. Box 4237, Chestertown, Md. 21690; telephone: (800) 277-3850. These wood screws 12 when used to join an 18 gauge steel member to a 2×4 stud made of Douglas-Fir Larch, grade No. 2 or better, under continuously dry conditions, have individual shear design loads of 268 pounds.

Figure 7:
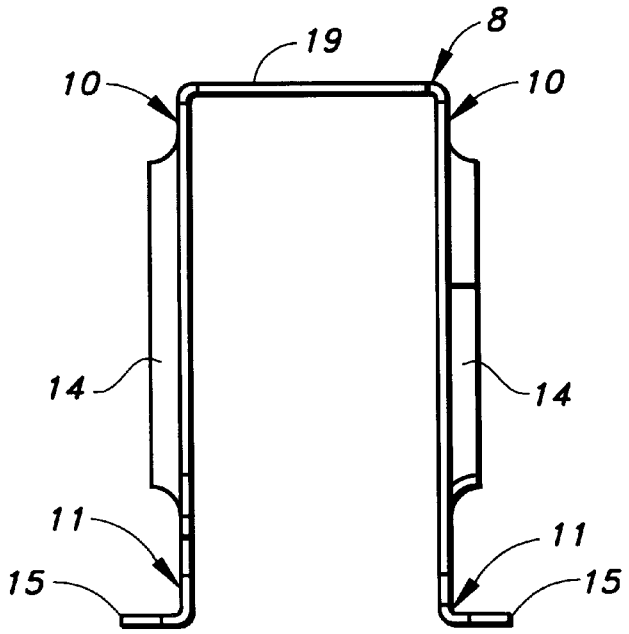
FIG. 7 is a top view of the bracket of the preferred embodiment taken along line 7—7 of FIG. 4.
Figure 8:
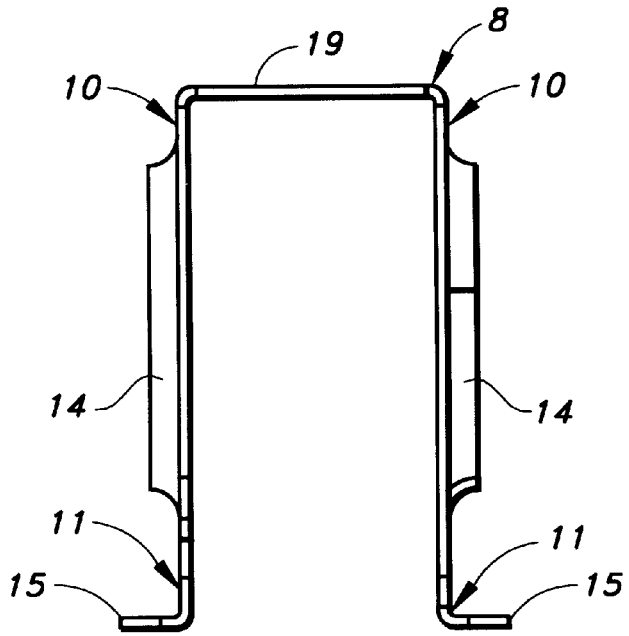
FIG. 8 is a bottom view of the bracket of the preferred embodiment taken along line 8—8 of FIG. 4.

As shown in FIG. 1 and FIGS. 7 and 8, the bracket 8 of the preferred embodiment is a c-shaped member. The bracket 8 of the preferred embodiment actually combines two pairs of first and second reinforcing members 10 and 11. One pair is disposed on one side face 4 of the building member 1 and the other pair is disposed on the opposite side face 4 with a connecting web 19 joining the first reinforcing members 10 of each pair. The connecting web 19 is formed to register with the first edge face 5 of the stud 1.

The connecting web 19 is formed to sit in close registration with the first edge face 5 of the stud 1 so that as little of the bracket 8 as possible extends past the first edge face 5 of the stud 1. It is usually common to attach sheetrock or gypsum board to the interior edge faces of the studs 1 of the bearing walls of a house. Any bracket 8 or other member that extends beyond the interior edge face of a stud 1 will interfere with the application of the sheetrock. In the case of the bracket 8 of the preferred embodiment, only the connecting web 19 extends past the first edge face 5 of the stud 1. Further, as is shown in FIGS. 2A and 2B, it is only the thickness of the connecting web 19 which extends past the stud 1, and since the preferred embodiment is made from a light gauge steel this presents a very small reveal problem that can be corrected, if necessary, in the finishing step of the sheetrock application.

The two pairs of first and second reinforcing members 10 and 11 in the bracket 8 of the preferred embodiment are similarly shaped; however, in one pair the second reinforcing member 11 is bent down from the bracket 8, and in the other pair, the second reinforcing member 11 is bent up from the bracket 8. This is possible, because in one pair of first and second reinforcing members 10 and 11 the bendable area 17 is located below the opening 7 in the building member 1 when the first and second reinforcing members 10 and 11 are attached to the building member 1, and in the second pair, the bendable area 17 is located above the opening 7. This makes it easier to offset the fastener openings 18 to avoid wood splitting. In positioning the fastener openings 18 on the bracket 8 of the preferred embodiment, it is necessary to take into account the fasteners 12 driven through each pair of first and second reinforcing members 10 and 11

It is to be noted that in the bracket 8 of the preferred embodiment, the first and second reinforcing members 10 and 11 substantially surround the building component 9 received by the building member 1 and the bracket 8.

In the bracket 108 of the alternative embodiment, shown in FIGS. 10–15, the first and second reinforcing members 110 and 111 do not substantially surround the building component 9. Rather, the main opening 113 between the first and second reinforcing members 110 and 111 extends to the bottom edge 120 of the bracket with a width that is large enough to receive the building component 9. In this particular embodiment, the first and second reinforcing members 110 and 111 are joined along the top of the bracket 121 and first end portions of the first and second reinforcing members 110 and 111. The main opening 113 is in the middle portions of the first and second reinforcing members 110 and 11 and extends through the second end portions of the reinforcing members 110 and 111 to the bottom edge 120 of the bracket 108. The first and second reinforcing members 110 and 111 could also be joined along the bottom edge 120 of the bracket 108 with the main opening 113 between the first and second reinforcing members 110 and 111 extending to the top edge 121 of the bracket.

As with the preferred embodiment, the first reinforcing member 110 is formed with two fastener openings 118 above and below the area where the building component 9 will be received, and the second reinforcing member 111 is formed with one fastener opening 118 above and one fastener opening 118 below the area where the building component 9 will be received.

As in the preferred embodiment, the second reinforcing member 111 is formed with a strengthening flange 115 that runs along its length.

In a departure from the preferred embodiment, the drawn reinforcing flange 114 at the perimeter of the main opening 113 in a portion of the first reinforcing member 110 extends around the perimeter of the main opening 113 to a portion of the second reinforcing member 111.

Like the preferred embodiment, the bracket 108 of the alternate embodiment is joined to the stud 1 with similar fasteners, and is formed of two pairs of first and second reinforcing members 110 and 111 joined by a connecting web 119 between the first reinforcing member 110 of each pair.

In accordance with the present invention, the second reinforcing member 111 is disposed in relation to the first reinforcing member 110 prior to installation in such a way as to allow the first reinforcing member 110 to be moved into position for attachment to the building member 1 by aligning the first reinforcing member 110 generally in the plane of the side face 4 of the building member and sliding the bracket 108 into place, even when the building component 9 already passes through the building member 1. Unlike, the preferred embodiment, the second reinforcing member 111 of the bracket 108 of the alternate embodiment is designed to stay in fixed relation to the first reinforcing member 110. The preferred wood screws are then used to attach the bracket 108 to the stud 1.

The bracket 8 of the preferred embodiment of the present invention is formed in the following manner. A sheet of 18 gauge, galvanized sheet metal, preferably steel, is fed into a progressive die press. Openings 18 and 16 for the fasteners 12 and for weakening the bendable area 17 between the first reinforcing member 10 and the second reinforcing member 11 are formed, and the outline of the blank is cut from the sheet metal. The strengthening flanges 15 on the second reinforcing members 11 are bent upward from the second reinforcing members 11 along flange bend lines 22, and the drawn reinforcing flanges 14 around the main openings 13 are formed by drawing the metal out of the plane of the first reinforcing members 10. At the edges of the first reinforcing members 10 are two main bend lines 23. The blank is bent down 90 degrees at these main bend lines 23 to give the bracket its c-shape. It is also preferable to label the bracket 8 with a warning to the installer that the second reinforcing member 11 should only be bent out of the plane of the first reinforcing member 10 once, during installation, so that the metal of the bracket 8 is not over worked.

The alternated embodiment of the bracket 108 of the present invention shown in FIGS. 10–15 is formed in the following manner. A sheet of 18 gauge, galvanized sheet metal is fed into a progressive press. Openings 118 for the fasteners are formed, and the outline of the blank is cut from the sheet metal. The flanges 115 on the second reinforcing members 111 are bent upward from the second reinforcing members 111, and the drawn strengthening flanges 114 around portions of the main openings 113 are formed by drawing the metal out of the plane of the first and second reinforcing members 110 and 111. At the edges of the first reinforcing members 110 are two main bend lines. The blank is bent down 90 degrees at these main bend lines to give the bracket 108 its c-shape.

We claim:

1. A connection to rehabilitate a weakened building member having a building component passing through said building member, said connection comprising:

a. said building member, having,
   1. top and bottom ends,
   2. opposed, generally planar side faces,
   3. a first edge face,
   4. a second edge face disposed away from said first edge face, and
   5. a cavity in one of said side faces that passes through said building member to said opposite side face, creating an opening in said building member;

b. said building component,
   1. said building component passing through said opening in said building member,
   2. said building component being disposed away from said first and second edge faces such that there is a space between said building component and each of said first and second edge faces;

c. a first reinforcing member disposed in registration with a portion of one of said side faces, 1. said first reinforcing member extending from an area above said opening in said building member to an area below said opening in said building member, and
2. said first reinforcing member passing around said building component and through said space between said building component and said first edge face;

d. a second reinforcing member disposed in registration with a portion of said same side face on which said first reinforcing member is in registration,
1. said second reinforcing member extending from an area above said opening in said building member to an area below said opening in said building member, and
2. said second reinforcing member passing around said building component and through said space between said building component and said second edge face;

e. means for joining said first and second reinforcing members to said building member, said means joining said first and second reinforcing members to said building member at said areas above and below said opening in said building member; and f. wherein said second reinforcing member can be disposed in relation to said first reinforcing member prior to installation in such a way as to allow said first reinforcing member to be moved into position for attachment to said building member, when said building component already passes through said building member before said first and second reinforcing members are attached, merely by generally aligning said first reinforcing member with said generally planar side face to which it will attach and sliding it along said plane of said side face into position.

2. The connection of claim of claim 1, wherein:

said second reinforcing member is formed with a strengthening flange.

3. The connection of claim 1, wherein:

fastener openings are formed in said first and second reinforcing members for receiving said means for joining said first and second reinforcing members to said building member.

4. The connection of claim 1, wherein:

a portion of said first reinforcing member is formed with a reinforcing flange.

5. The connection of claim 1, wherein:

additional said first and second reinforcing members are attached to the second of said opposed side faces of said building member.

6. The connection of claim 1, wherein:

a. additional said first and second reinforcing member are attached to the second of said opposed side faces of said building member; and b. said connection further comprises a connecting web connecting said first reinforcing members to each other.

7. The connection of claim 1, wherein:

said first and second reinforcing members are connected to each other.

8. The connection of claim 7, wherein:

a. additional said first and second reinforcing members are attached to the second of said opposed side faces of said building member and to each other; and b. said connection further comprises a connecting web connecting said first reinforcing members to each other.

9. The connection of claim 1, wherein:

said means for joining said first and second reinforcing members to said building member are self-drilling wood screws.

10. The connection of claim 1, wherein:

a. said first and second reinforcing members each have a first end portion, a second end portion, and a middle portion;

b. said first and second reinforcing members are connected to each other at said first end portions; and c. said first and second reinforcing members are separated sufficiently from each other along said middle and second end portions to allow said building component to pass between said first and second reinforcing members.

11. The connection of claim 1, wherein:

portions of said first and second reinforcing members that are disposed adjacent to said building component, when said first and second reinforcing members are attached to said building member, are formed with a reinforcing flange to strengthen said first and second reinforcing members.

12. The connection of claim 10, wherein:

a. additional said first and second reinforcing members are attached to the second of said opposed side faces of said building member; and b. said connection further comprises a connecting web connecting said first reinforcing members to each other.

13. The connection of claim 1, wherein:

a. said first reinforcing member and said second reinforcing member generally lie in a plane, when said first and second reinforcing member are attached to said building member; and b. said first and second reinforcing members are connected to each other along a bendable area that allows said second reinforcing member to be bent out of said plane.

14. The connection of claim 13, wherein:

said bendable area is located below said opening in said building member when said first and second reinforcing members are attached to said building member.

15. The connection of claim 13, wherein:

said bendable area is located above said opening in said building member when said first and second reinforcing members are attached to said building member.

16. The connection of claim 13, wherein:

fastener openings are formed in said first and second reinforcing members for receiving said means for joining said first and second reinforcing members to said building member, said fastener openings being disposed above and below said opening in said building member in each of said first and second fastener receiving members.

17. The connection of claim 13, wherein:

a. additional said first and second reinforcing members are attached to the second of said opposed side faces of said building member; and b. said connection further comprises a connecting web connecting said first reinforcing members to each other.

18. A connection to rehabilitate a weakened building member adapted for passing a building component therethrough, said connection comprising:

a. said building member, having,
1. top and bottom ends,
2. opposed, generally planar side faces,
3. a first edge face,
4. a second edge face disposed away from said first edge face, and
5. a cavity in one of said side faces that passes through said building member to said opposite side face, creating an opening in said building member;

b. said building component, 1. said building component passing through said opening in said building member,
2. said building component being disposed away from said first and second edge faces such that there is a space between said building component and each of said first and second edge faces;

c. a bracket, having, 1. a first reinforcing member,
2. a second reinforcing member,
3. said first and second reinforcing members being adapted for connecting to one of said building member side faces, such that said first reinforcing member extends from an area above said opening in said building member to an area below said opening in said building member and said first reinforcing member passes around said building component and through said space between said building component and said first edge face, and said second reinforcing member extends from an area above said opening in said building member to an area below said opening in said building member and said second reinforcing member passes around said building component and through said space between said building component and said second edge face;
4. said bracket being formed with a main opening, said main opening being adapted for receiving said building component, said main opening having a perimeter, a portion of which is made up of part of said first reinforcing member and a portion of which is made up of a part of said second reinforcing member, and
5. said second reinforcing member being replaceably removable, and being dimensioned and adapted for allowing said building component to pass laterally through said portion of said perimeter made up of a part of said second reinforcing member; and d. means for joining said first and second reinforcing members to said building member, said means joining said first and second reinforcing members to said building member at said areas above and below said opening in said building member.

19. A method for rehabilitating a weakened building member having a building component passing through an opening in said building member, comprising:

a. applying a bracket to a first side face of said building member, said building member having top and bottom ends, opposed generally planar side faces, a first edge face, a second edge face disposed away from said first edge face, and a cavity in one of said side faces that passes through said building member to said opposite side face, creating an opening in said building member wherein said building component passes through said opening, said building component being disposed away from said first and second edge faces such that there is a space between said building component and each of said first and second edge faces, said bracket having a substantially planar first reinforcing member and a second reinforcing member connected to said first reinforcing member, said bracket being applied to said first side face of said building member in such a manner that said first reinforcing member is in registration with said building member, said first reinforcing member extends to an area on said building member above said opening in said building member and to an area of said building member below said opening in said building member, and said first reinforcing member passes around said building component and through said space between said building component and said first edge face;

b. bending said second reinforcing member into alignment with said first reinforcing member and said first side face of said building member such that said second reinforcing member lies adjacent said building component and on the opposite side of said building component from said first reinforcing member, said second reinforcing member extending from an area above said opening in said building member to an area below said opening in said building member, and said second reinforcing member passing around said building component and through said space between said building component and said second edge face; and c. attaching said first reinforcing member and said second reinforcing member to said building member with fasteners.

20. The connection of claim 17, wherein:

said bendable area is located below said opening in said building member when said first and second reinforcing members are attached to said building member.

21. The connection of claim 17, wherein:

said bendable area is located above said opening in said building member when said first and second reinforcing members are attached to said building member.

* * * * *

UNITED STATES PATENT AND TRADEMARK OFFICE

CERTIFICATE OF CORRECTION

PATENT NO. : 6,176,057 B1
DATED : January 23, 2001
INVENTOR(S) : Robert D. Bouchet et al.

It is certified that error appears in the above-identified patent and that said Letters Patent is hereby corrected as shown below:

Title page,
Item [75] Inventors, replace "Ballush" with -- Ballash --.

Column 9, claim 2,
Line 34, replace "of claim of claim 1" with -- of claim 1 --.

Signed and Sealed this

Nineteenth Day of March, 2002

*Attest:*

*Attesting Officer*

JAMES E. ROGAN
*Director of the United States Patent and Trademark Office*